US008548341B2

(12) United States Patent
Itoh

(10) Patent No.: US 8,548,341 B2
(45) Date of Patent: Oct. 1, 2013

(54) IMAGE FORMING APPARATUS PROVIDED WITH MECHANISM FOR CLEANING IMAGE CARRIER

(75) Inventor: Masatoshi Itoh, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 504 days.

(21) Appl. No.: 12/905,593

(22) Filed: Oct. 15, 2010

(65) Prior Publication Data

US 2011/0103818 A1 May 5, 2011

(30) Foreign Application Priority Data

Oct. 30, 2009 (JP) ..... 2009-251354

(51) Int. Cl.
*G03G 15/00* (2006.01)

(52) U.S. Cl.
USPC ..... 399/36; 399/71; 399/167; 399/350

(58) Field of Classification Search
USPC ..... 399/36, 71, 77–78, 167, 350
See application file for complete search history.

(56) References Cited

U.S. PATENT DOCUMENTS 6,212,339 B1 * 4/2001 Inoue et al.
7,120,376 B2 10/2006 Saito et al.

FOREIGN PATENT DOCUMENTS

JP 61043758 A * 3/1986
JP 2005-062280 A 3/2005
JP 2006-330299 A 12/2006

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

A control unit temporarily stops an image carrier when transfer of an image formed using a developer to a recording medium ends. Thereafter, the control unit controls a drive source to intermittently drive the image carrier N times. A measuring unit measures an amount of rotation of the image carrier when the image carrier is intermittently driven. A determination unit determines an amount of rotation for stop instruction issuance that will be applied to a next drive. The amount of rotation for stop instruction issuance is based on an amount of inertial rotation measured from when a stop instruction is issued until when the image carrier stops rotating, and a target amount of rotation for each time the image carrier is driven.

13 Claims, 17 Drawing Sheets

FIG. 16

| i | Da(i) |
|---|---|
| 1 | 9 |
| 2 | 18 |
| 3 | 27 |
| 4 | 36 |
| 5 | 45 |
| ⋮ | ⋮ |

IMAGE FORMING APPARATUS PROVIDED WITH MECHANISM FOR CLEANING IMAGE CARRIER

BACKGROUND OF THE INVENTION

1. Field of the Invention

The present invention generally relates to an image forming apparatus that is provided with image carriers, and in particular to control for cleaning the image carriers.

2. Description of the Related Art

Transfer-system image forming apparatuses that adopt an electrophotographic process, an electrostatic recording process, or the like need to clean a developer that has not transferred to paper and remains on the surface of an image carrier. However, if the image carrier and a cleaning blade are left in contact with each other, finely-powdered toner, an additive agent, and the like aggregate in such a contact area, which causes streaks and image blurring (density fluctuation and the like) to occur. Generally, a friction coefficient μ of the portion of the surface (peripheral surface) of the image carrier on which finely-powdered toner and the like aggregate relatively becomes lower. Thus, the rotational velocity (circumferential velocity) of the image carrier becomes temporarily faster while the cleaning blade is passing the portion in which the friction coefficient μ is low. This is a cause of streaks and image blurring.

According to the invention disclosed in Japanese Patent Laid-Open No. 2005-62280, it has been proposed that an image carrier is stopped when image formation ends, finely-powdered toner is removed by slightly rotating the image carrier thereafter, and toner agglomerate is reduced by further rotating the image carrier in reverse.

With an image forming apparatus that is provided with a plurality of image carriers side by side and forms multicolor images, it is important to match the rotation phases of the image carriers to reduce color misalignment. Color misalignment occurs due to image formation positions (transfer positions) of a plurality of image carriers that respectively correspond to different colors not matching. Japanese Patent Laid-Open No. 2006-330299 has proposed that the phases are aligned after image formation ends such that the phase difference between a plurality of image carriers becomes smaller, and thereafter the image carriers are stopped.

However, Japanese Patent Laid-Open No. 2006-330299 does not take into consideration the cleaning sequence after image formation ends as disclosed in Japanese Patent Laid-Open No. 2005-62280. Specifically, if the cleaning sequence is executed after the phases are aligned, there is a possibility that the phases may shift again. Generally, in the image forming apparatuses that have a plurality of stations, the stations are respectively equipped with a different cartridge. Specifically, since the load on each motor differs depending on the wear state of the cartridges and the difference therebetween, the amount of movement of the surface (peripheral surface) of the carriers will also differ. This also leads to a possibility of increasing the phase difference between the image carriers. Note that the phases may be aligned when the image carriers are started up next time, which will increase a first print-out time.

SUMMARY OF THE INVENTION

In view of this, a feature of the present invention is to solve at least one of such problems and other problems. For example, a feature of the present invention is to reduce streaks, image blurring, and color misalignment by reducing the phase difference due to the variations between loads on drive sources that drive image carriers without increasing a first print-out time. It should be noted that means to solve the other problems shall become apparent through the entire specification.

An image forming apparatus of the present invention is provided with, for example, an image carrier that carries an image formed using a developer, a drive source that drives the image carrier to rotate, a cleaning member that contacts the image carrier and removes the developer from the surface of the image carrier, a control unit, a measuring unit, and a determination unit. The control unit controls the drive source such that when transfer of the image formed using the developer to a recording medium ends, the image carrier is temporarily stopped, and thereafter the image carrier is intermittently driven N times (N is a natural number of two or more). The measuring unit measures an amount of rotation of the image carrier when the image carrier is intermittently driven. The measuring unit measures an amount of drive rotation Ct since driving of the image carrier has started. The control unit issues a stop instruction to the drive source when an amount of drive rotation Ct reaches a prescribed amount of rotation for stop instruction issuance Mt. The determination unit determines an amount of rotation for stop instruction issuance Mt that will be applied to a next drive based on an amount of inertial rotation Cl that is measured by the measuring unit from when the stop instruction is issued until when the image carrier stops rotating, and a target amount of rotation D during the intermittent drive of the image carrier.

According to the present invention, control is performed such that the final amount of rotation when an image carrier is intermittently driven N times reaches a prescribed amount, thus reducing the phase difference due to variations between loads on the drive sources. Accordingly, it is possible to reduce streaks, image blurring, and color misalignment resulting from the phase difference between the image carriers, without increasing the first print-out time.

Further features of the present invention will become apparent from the following description of exemplary embodiments with reference to the attached drawings.

BRIEF DESCRIPTION OF THE DRAWINGS

FIG. 16 is a diagram showing an example of a table having stored therein target total amounts of rotation.

DESCRIPTION OF THE EMBODIMENTS

Embodiments of the present invention are described below. The individual embodiments described below are useful for understanding various concepts of the present invention, such as superordinate concepts, intermediate concepts, and subordinate concepts. The technical scope of the invention is determined by the appended claims, and therefore is not limited by the individual embodiments described below.

Embodiment 1

Figure 1:
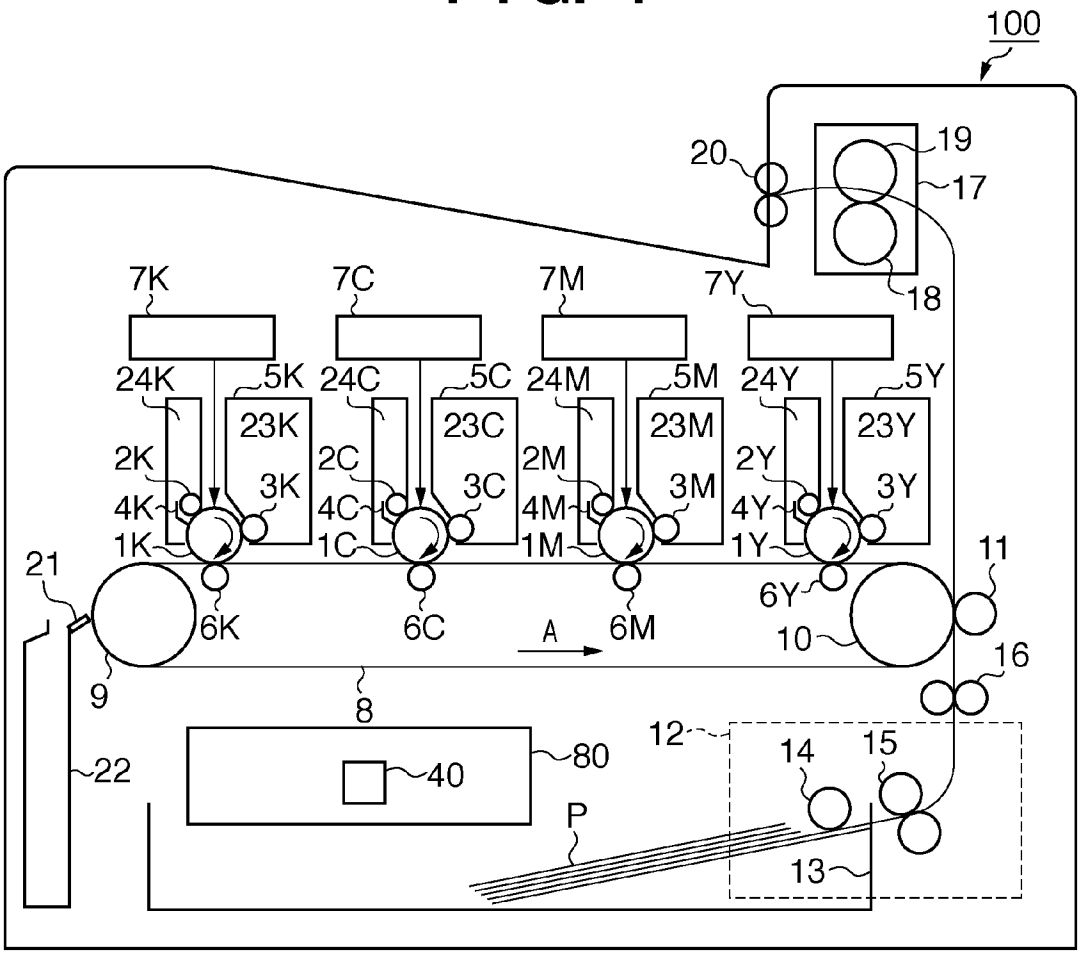
FIG. 1 is a schematic cross-sectional view of a multicolor image forming apparatus.

FIG. 1 is a schematic cross-sectional view of a multicolor image forming apparatus 100 (hereinafter referred to as a main body). YMCK given as the suffix of reference numerals in FIG. 1 denote the colors (yellow, magenta, cyan, and black) of toner, which is a developer. Below, YMCK is omitted when describing aspects in common with all the colors.

The image forming apparatus 100 is provided with four process cartridges 5 that are detachable from the main body. Although the basic structure of these four process cartridges 5 is the same, the difference thereof is to respectively form images with a different color of toner. Each of the process cartridges 5 has a toner container 23, a photosensitive drum 1 serving as an image carrier, a charging roller 2, a developing roller 3, a drum cleaning blade 4, and a waste toner container 24.

Laser units 7 are arranged above the process cartridges 5. The laser unit 7 exposes the corresponding photosensitive drum 1 based on an image signal. The photosensitive drums 1 are charged to a prescribed electric potential by the charging rollers 2, and thereafter an electrostatic latent image is formed on each of the drums by the laser unit 7 performing exposure. Each of the developing rollers 3 develops the electrostatic latent image using the toner stored in the toner container 23, thereby forming a toner image on the surface (peripheral surface) of the photosensitive drum 1.

An intermediate transfer belt unit is provided with an intermediate transfer belt 8, a driving roller 9, and a secondary transfer opposing roller 10. Primary transfer rollers 6 are disposed inside the intermediate transfer belt 8, opposing the photosensitive drums 1. Toner images having different colors from each other formed on the surface of the photosensitive drums 1 are sequentially subjected to primary transfer to be transferred onto the surface of the intermediate transfer belt 8. The four colors of toner images that have been transferred onto the intermediate transfer belt 8 are conveyed to a secondary transfer roller 11, where the toner images are subjected to secondary transfer to be transferred onto a transfer material P. The transfer material may be called a recording medium, paper, or the like.

A feeding conveying apparatus 12 has a paper feed roller 14 for feeding the transfer material P from the inside of a paper feed cassette 13 for storing the transfer materials P, and a pair of conveying rollers 15 for conveying the fed transfer material P. The transfer material P conveyed from the feeding conveying apparatus 12 is conveyed to the secondary transfer roller 11 by a pair of registration rollers 16.

The transfer material P on which the toner images have been transferred is conveyed to a fixing apparatus 17. The transfer material P is heated and pressed by a fixing roller 18 and a pressure roller 19, and the toner images are fixed on the surface of the transfer material. A pair of discharge rollers 20 discharges the transfer material P with the fixed toner images.

On the other hand, toner remaining on the surface of the photosensitive drums 1 that have been subjected to primary transfer is removed by the drum cleaning blades 4 that are in contact with the drums, and is collected in the waste toner containers 24. The drum cleaning blade 4 is an example of a cleaning member that contacts the drum serving as an image carrier and removes a developer from the surface of that drum. Toner remaining on the surface of the intermediate transfer belt 8 that has been subjected to secondary transfer is also removed by a transfer belt cleaning blade 21, and collected in a waste toner collecting container 22. Note that the cleaning members do not necessarily need to be blade-like members.

An electric circuit such as a CPU 40 for controlling the main body is mounted on a control board 80. The CPU 40 performs overall control of the operation of the main body, such as control of a drive source related to conveyance of the transfer material P and drive sources of the process cartridges 5, control with regard to image formation, and the like.

Figure 2:
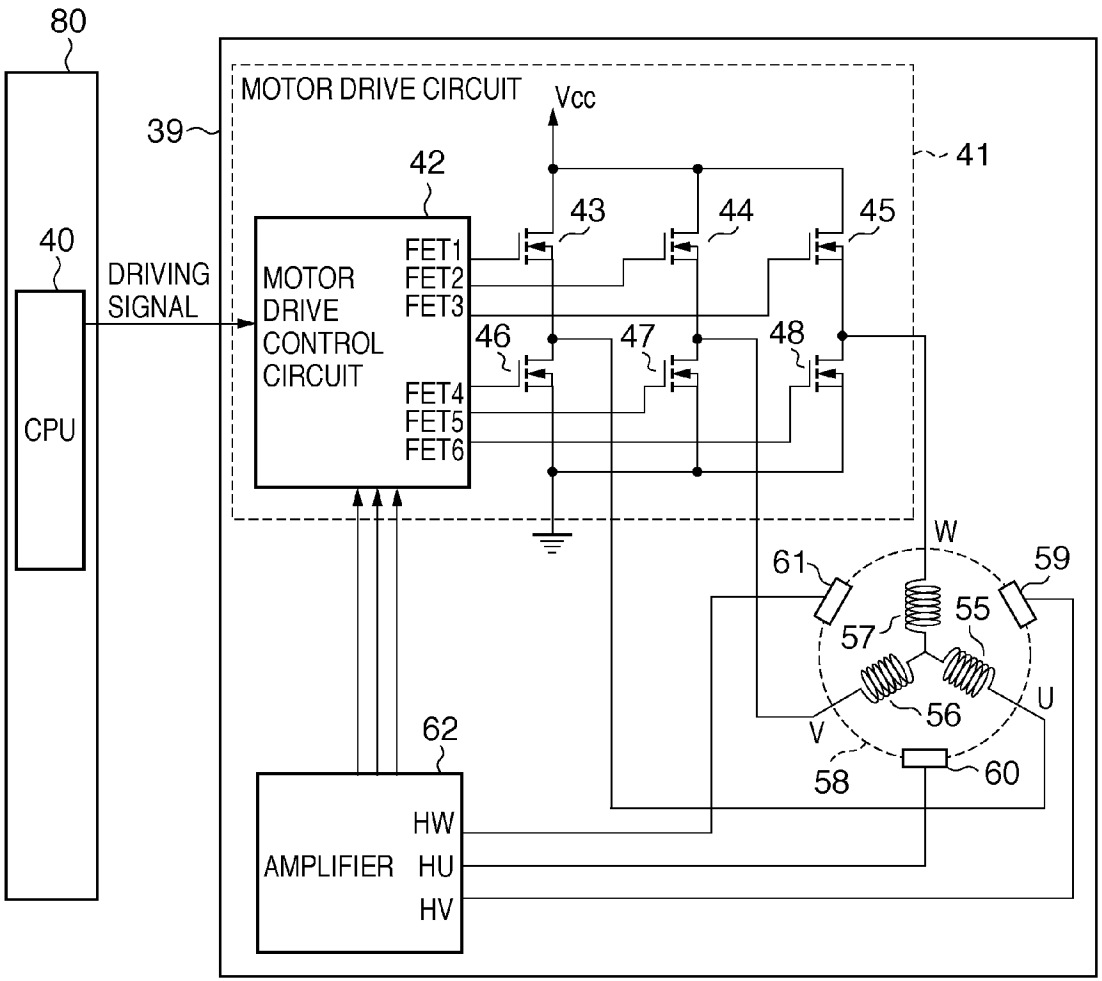
FIG. 2 is a diagram showing a drive circuit of a DC brushless motor.

FIG. 2 is a diagram showing a drive circuit of a DC brushless motor (hereinafter, referred to as a motor 39). The motor 39 is an example of a drive source for driving image carriers to rotate, and is provided with Y-connected coils 55 to 57 and a rotor 58. Furthermore, the motor 39 is provided with three Hall elements 59, 60, and 61 for detecting the rotational position of the rotor 58. The output (position detection signal) from each of the Hall elements 59 to 61 is amplified by an amplifier 62, and is inputted to a motor drive control circuit 42.

A drive circuit 41 is provided with the motor drive control circuit 42, FETs 43, 44, and 45 on the high side, and FETs 46, 47, and 48 on the low side. The FETs 43 to 48 are respectively connected to U, V, and W, which are the ends of the coils. The FETs 43 to 48 rotate the rotor 58 by switching the phase to excite in accordance with a phase switch signal outputted from the motor drive control circuit 42. The motor drive control circuit 42 generates a phase switch signal according to a driving signal from the output port of the CPU 40 and position detection signals outputted from the Hall elements 59 to 61.

Figure 3B:
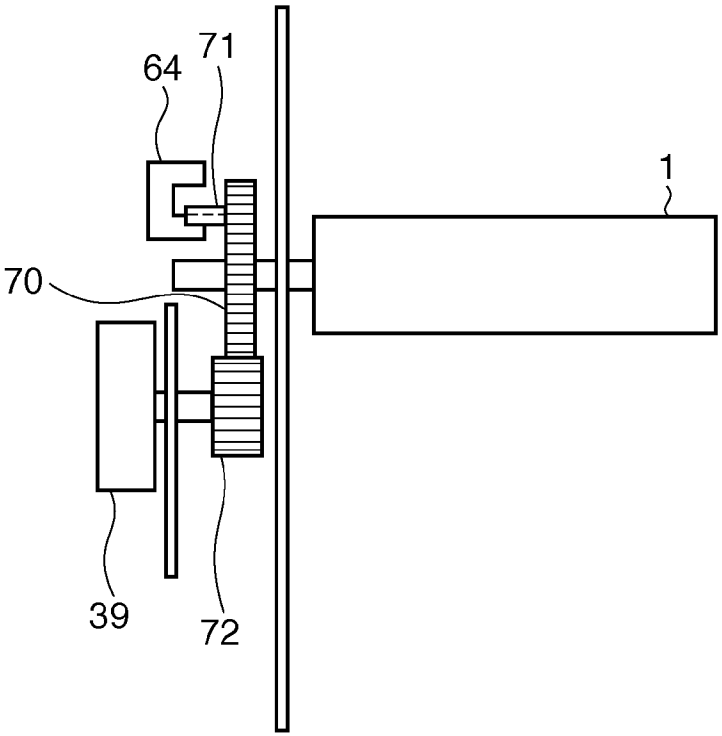
FIGS. 3A and 3B are diagrams showing the motor, a photosensitive drum, and a rotation phase detection mechanism.
Figure 3A:
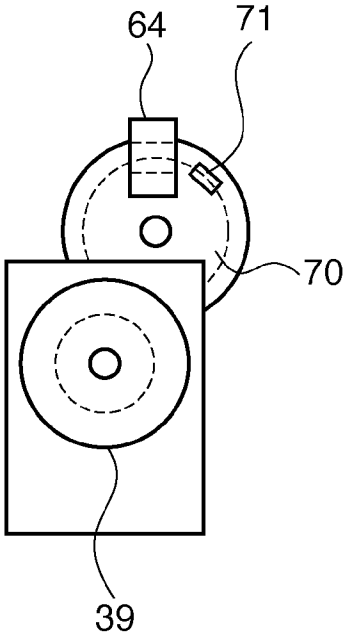

FIGS. 3A and 3B show the motor 39, the photosensitive drum 1, and a mechanism of detecting a rotation phase of the photosensitive drum 1. FIG. 3A is a diagram of the above elements viewed in the rotating shaft direction of the motor 39 and the photosensitive drum 1. FIG. 3B is a diagram of the above elements viewed in the direction parallel to the rotating shafts of the motor 39 and the photosensitive drum 1.

A gear 70 rotates together with the photosensitive drum 1, and drives the photosensitive drum 1. The gear 70 is provided with a flag 71. The flag 71 blocks the optical path of a photosensor 64 along with the rotation of the photosensitive drum 1. Accordingly, whenever the photosensitive drum 1 makes one rotation, a pulse signal is outputted from the photosensor 64. In this way, the flag 71 is used to specify the home position of the photosensitive drum 1. Note that the amounts of rotation of the photosensitive drum 1 and the motor 39 may be detected based on the pulse signal outputted from the photosensor 64. However, compared to a rotation detecting unit 68 described later, the precision of this method is not high. A gear 72 is provided on an output shaft of the motor 39. The driving force of the motor 39 is transferred to the photosensitive drum 1 by the gear 72 and the gear 70 engaging with each other.

Figure 4:
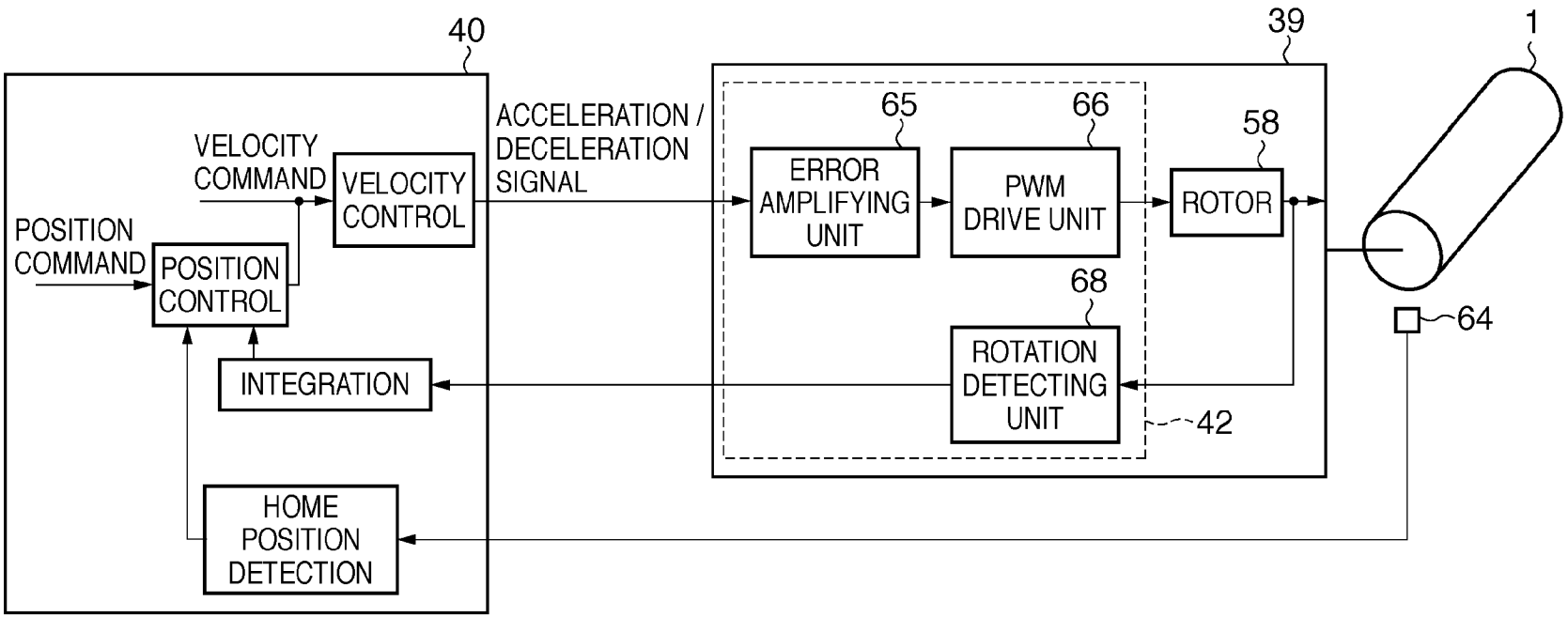
FIG. 4 is a control block diagram with regard to control of the rotational velocity of a motor 39.

FIG. 4 is a control block diagram with regard to controlling the rotational velocity of the motor 39. The description is simplified by giving the same reference numerals to the elements that have already been described. In order to control the rotational velocity (angular velocity) of the motor 39, the CPU 40 compares a rotational velocity target value determined in advance with rotational velocity information indicating the actual rotational velocity, and determines velocity error information. In order to perform position control, the CPU 40 compares information on the position of the rotor 58 obtained by integrating the rotational velocity information with a position target value, and determines position error information. The CPU 40 calculates the amount of operation of the motor based on the velocity error information and the position error information, generates an acceleration or deceleration signal, and transmits the signal to the motor 39.

An error amplifying unit 65 amplifies the acceleration or deceleration signal, and outputs the signal to a PWM drive unit 66. PWM is the abbreviation for pulse width modulation. The PWM drive unit 66 rotates the rotor 58 according to the acceleration or deceleration signal by performing PWM driving on the FET 43 to 48. The rotation detecting unit 68 detects the rotational velocity of the rotor 58 or the photosensitive drum 1, and feeds back the detected velocity to the CPU 40 as rotational velocity information. The rotation detecting unit 68 outputs a pulse signal (FG signal) in synchronization with the rotation of the motor 39. The CPU 40 calculates the rotational velocity and the rotational angle of the motor based on the output signal. The rotation detecting unit 68 outputs a pulse signal configured by 45 pulses each time the output shaft of the motor 39 makes one rotation, for example. Specifically, the output of one pulse means that the rotor 58 has rotated 8° ($\pi/22.5$ [rad]).

Figure 5:
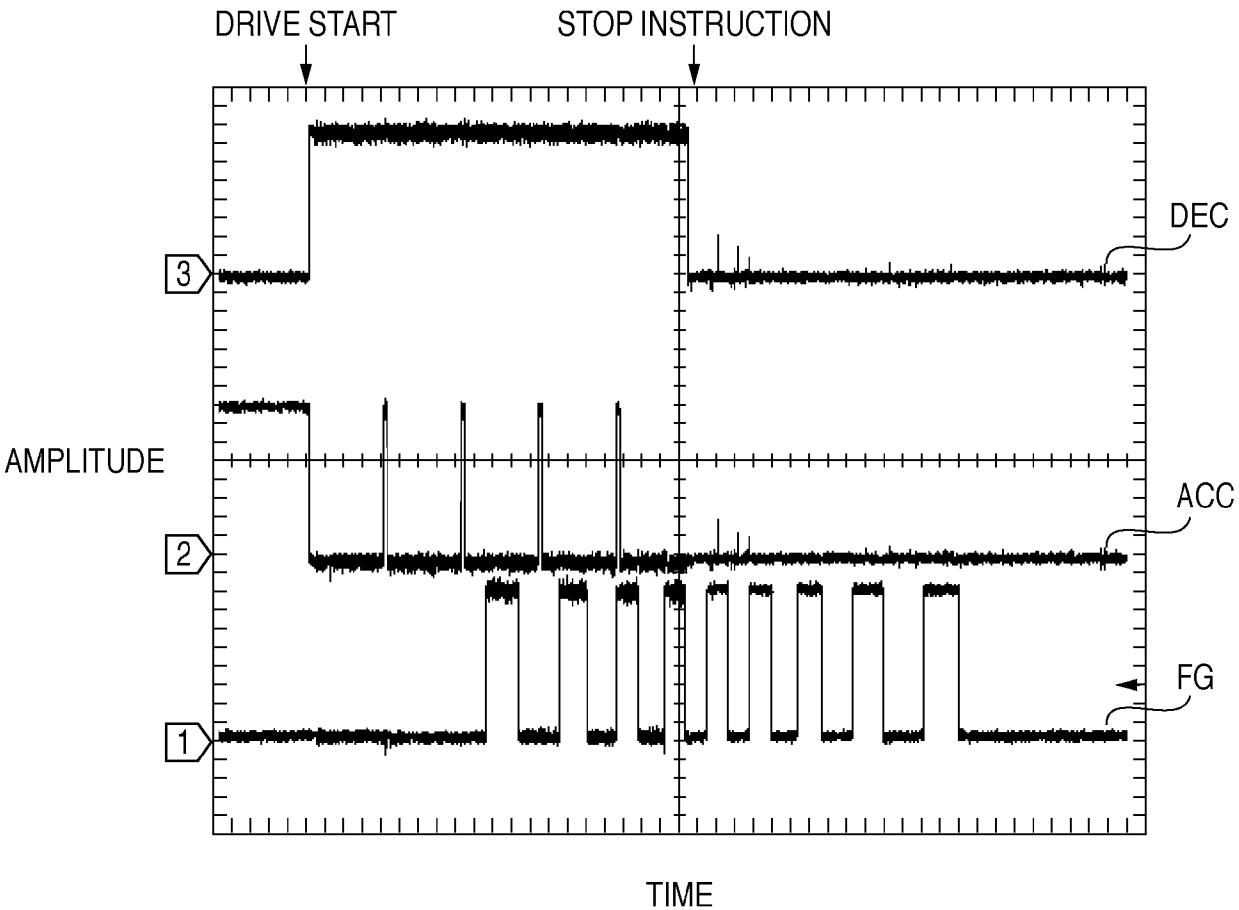
FIG. 5 is a diagram showing the relationship of an FG signal and acceleration and deceleration signals (ACC, DEC) corresponding to starting up and stopping the motor.

FIG. 5 is a diagram showing the relationship between an FG signal and acceleration and deceleration signals (ACC, DEC) corresponding to starting up and stopping the motor. DEC denotes a driving signal that means deceleration, and ACC denotes a driving signal that means acceleration. An FG signal is a pulse signal outputted by the rotation detecting unit 68. If the DEC signal is high and the ACC signal is low, the motor 39 is accelerated. On the other hand, if the DEC signal is low and the ACC signal is also low, the brakes are applied to the motor 39. Thus, the CPU 40 issues an instruction to stop the motor 39 by making the DEC signal low and also the ACC signal low. FIG. 5 shows that the FG signals are outputted even after the stop instruction has been issued. This indicates that the rotor 58 of the motor 39 is still rotating due to inertial force.

Figure 6:
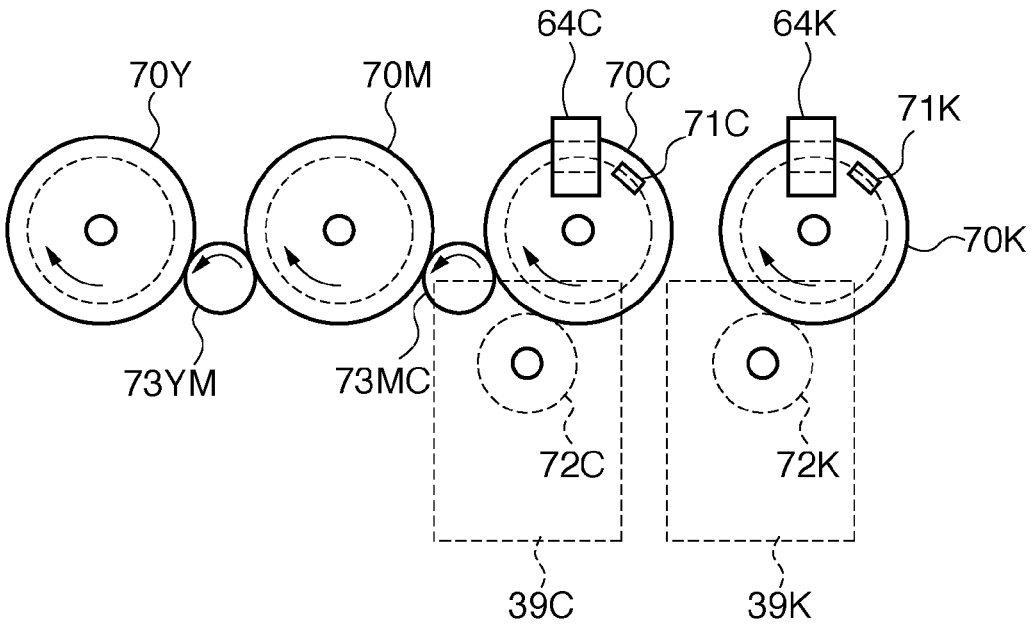
FIG. 6 is a diagram illustrating the driving configuration of photosensitive drums.

FIG. 6 is a diagram illustrating the driving configuration of the photosensitive drums. In the present embodiment, a description is given assuming that the four photosensitive drums 1 are driven by two motors (one for color, and one for black). Of course, three or more motors 39 may be used.

A motor 39C drives color photosensitive drums 1Y, 1M, and 1C via gears 72C and 70C. A motor 39K drives a black photosensitive drum 1K via gears 72K and 70K. Here, a gear 73YM and a gear 73MC are respectively provided between gears 70Y and 70M and the gears 70M and 70C for driving the color photosensitive drums. The ratio of the number of teeth of the gears 73YM and 73MC to the number of teeth of the gears 70Y, 70M, and 70C for driving the photosensitive drums 1 is an integer ratio. Accordingly, the rotation phases of the color photosensitive drums 1Y, 1M, and 1C are always the same. Note that loads on the motors 39C and 39K differ from each other, and thus adjustment is necessary between the rotation phase of the black photosensitive drum 1K and the rotation phase of the color photosensitive drums 1Y, 1M, and 1C. For this reason, only two photosensors 64C and 64K that detect rotation phases of the photosensitive drums are provided. In the present embodiment, the state where the signals of the phase detection sensors of the photosensitive drums match is a desired phase relationship of AC components in which color misalignment can be suppressed.

Figure 7:
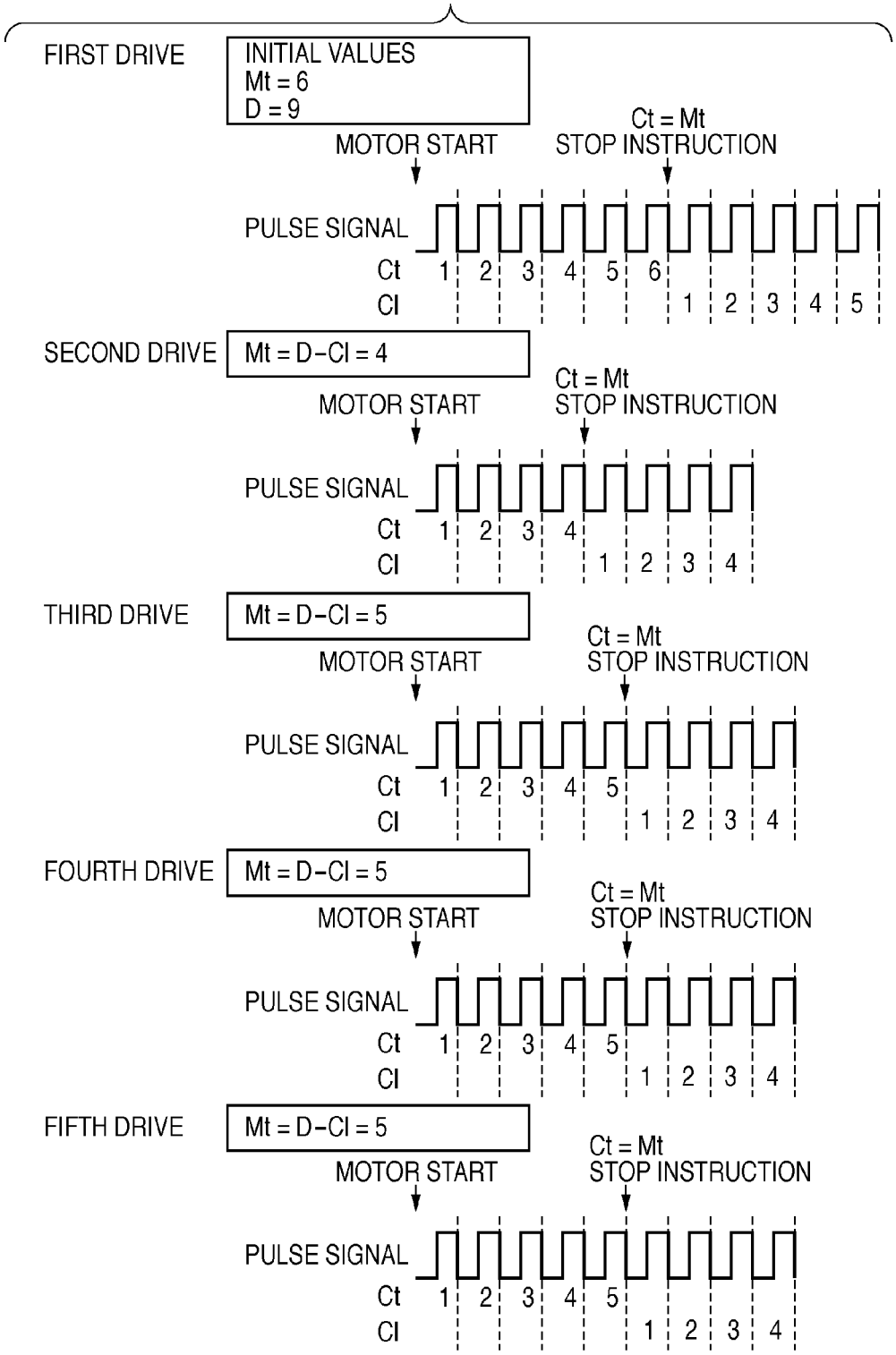
FIG. 7 is a diagram illustrating a photosensitive drum stop sequence.

FIG. 7 is a diagram illustrating a photosensitive drum stop sequence. The photosensitive drum stop sequence is a sequence that is executed to reduce streaks and image blurring (density fluctuation and the like) after transfer of toner images has ended. For example, the photosensitive drum 1 is temporarily stopped, and thereafter the photosensitive drum 1 is intermittently driven five times. Note that the rotational direction of the photosensitive drum 1 is the same as the rotational direction thereof when performing image formation. This is referred to as positive rotation. The distance that the surface of the photosensitive drum 1 moves by intermittently driving the photosensitive drum 1 N times is longer than the width of a nip portion formed by the photosensitive drum 1 and the drum cleaning blade 4 being in contact with each other. The width of the nip portion is the length in a direction that is substantially orthogonal to the axial direction of the photosensitive drum 1. Hereinafter, the three color photosensitive drums 1Y, 1M, and 1C are represented by the photosensitive drum 1C, for the convenience of the description.

In Embodiment 1, rising of position detection signals detecting the respective positions of the photosensitive drums 1K and 1C is detected after the end of image formation. The motors 39C and 39K are stopped after a prescribed time period has elapsed after this rising. Note that this prescribed time period is a time that has been determined such that the photosensitive drums 1K and 1C each stop in the desired phases in which color misalignment between the photosensitive drums 1K and 1C can be reduced.

In FIG. 7, Mt denotes an amount of rotation for stop instruction issuance used as a basis for issuing a stop instruction. Specifically, Mt indicates the number of pulses that will be counted from when the motor 39 starts driving (starts up) until when a stop instruction is issued, the pulses being included in a pulse signal outputted from the rotation detecting unit 68. The initial value of Mt is determined based on, for example, the result of experimentation for reducing color misalignment, streaks, and the like.

Ct indicates the amount of drive rotation measured from the start of driving the photosensitive drum 1. Specifically, Ct indicates the number of the pulses counted from when the motor 39 starts driving (starts up). Counting Ct will be stopped due to issuance of a stop instruction. The CPU 40 issues a stop instruction to the motor drive control circuit 42 when the amount of drive rotation Ct matches the amount of rotation for stop instruction issuance Mt. The brakes are applied to the motor 39.

Cl indicates the amount of inertial rotation of the motor 39 or the photosensitive drum 1. Specifically, in Embodiment 1, Cl indicates the number of pulses counted from when a stop instruction is issued to the motor 39 until when the photosensitive drum 1 actually stops rotating. The motor drive control circuit 42 that has received a stop instruction applies brakes to the motor 39. However, the motor 39 continues rotating according to inertial force. Accordingly, it is necessary to also measure the amount of inertial rotation Cl. Specifically, this is because not only the amount of rotation when driving, but also the amount of rotation due to inertia needs to be measured, otherwise the rotation phases of the motor 39 and the photosensitive drum 1 cannot be accurately controlled.

D indicates a target amount of rotation corresponding to the target amount of movement of the surface of the photosensitive drum 1. The target amount of movement is determined based on, for example, the result of experimentation for reducing color misalignment, streaks, and the like. In Embodiment 1, the target amount of rotation D indicates the number of pulses to be outputted each time the photosensitive drum 1 is driven. In Embodiment 1, the CPU 40 corrects the amount of rotation for stop instruction issuance Mt that will be applied to the next drive, based on the amount of inertial rotation Cl and the target amount of rotation D. In this way, the amount of movement of the photosensitive drum 1 in the next intermittent drive approximates the target amount of movement. In the case of FIG. 7, since the photosensitive drum 1 is intermittently driven five times, the next drive means at least any of the second to fifth drives.

As shown in FIG. 7, Mt=6 and D=9 are set as the initial values applied to the first intermittent drive. Accordingly, the CPU 40 issues a stop instruction when the amount of drive rotation Ct reaches six. As a result, the CPU 40 observes five pulses as the amount of inertial rotation Cl. The CPU 40 calculates the difference between the target amount of rotation D and the amount of inertial rotation Cl (D−Cl=4), and determines this difference as the amount of rotation for stop instruction issuance Mt that will be applied to the second intermittent drive. In the following processing, the CPU 40 corrects or determines the amounts of rotation for stop instruction issuance Mt for the third to fifth intermittent drives using the same procedure.

Figure 8:
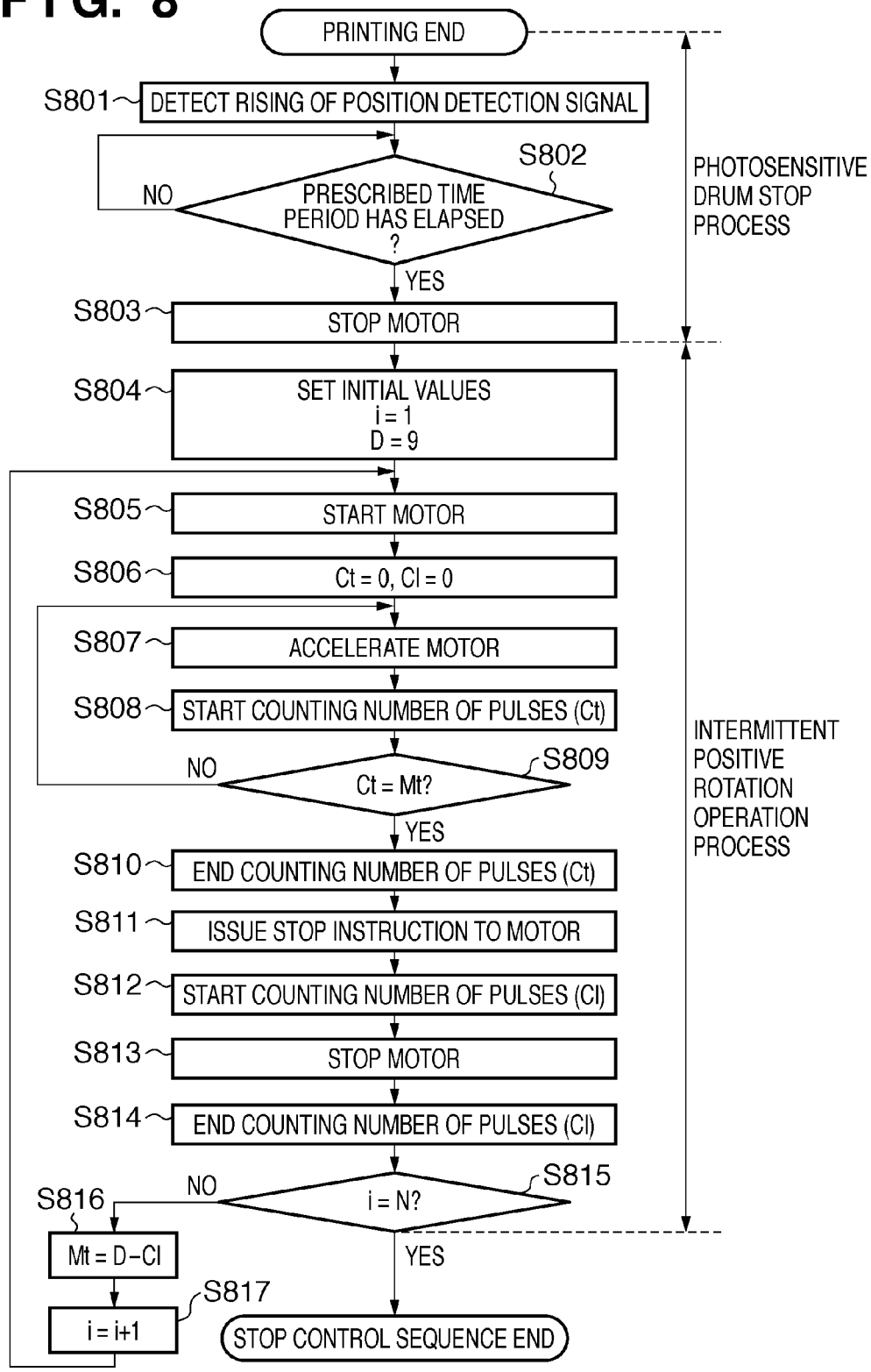
FIG. 8 is a flowchart showing an example of the stop sequence.

FIG. 8 is a flowchart showing an example of a stop sequence. The stop sequence is roughly divided into a photosensitive drum stop process and an intermittent positive rotation operation process. The CPU 40 executes the stop sequence after printing ends.

Photosensitive Drum Stop Process

In S801, the CPU 40 detects rising of a pulse outputted from the position detection sensor of the photosensitive drum 1. In S802, the CPU 40 judges whether or not a prescribed time period has elapsed. If it is judged that the prescribed time period has elapsed, the processing proceeds to S803, where the CPU 40 stops the motor 39.

Intermittent Positive Rotation Operation Process

In S804, the CPU 40 sets variables to initial values. The CPU 40 sets the amount of rotation for stop instruction issuance Mt to 6, and sets the target amount of rotation D to 9, for example. Further, a variable i that indicates the number of the current intermediate drive is set to 1. Note that the total number of intermittent drives N is set to 5.

In S805, the CPU 40 starts up the motor 39. In S806, the CPU 40 resets the counters for counting the amount of drive rotation Ct and the amount of inertial rotation Cl due to each drive to zero. In S807, the CPU 40 accelerates the motor 39 with certain angular acceleration. In S808, the CPU 40 starts counting the amount of drive rotation Ct. In S809, the CPU 40 compares the amount of rotation for stop instruction issuance Mt with the amount of drive rotation Ct, and judges whether or not both the amounts are the same. If the comparison does not show Ct=Mt, the processing returns to step S807. On the other hand, If the comparison shows Ct=Mt, the processing proceeds to step S810.

In S810, the CPU 40 ends counting the amount of drive rotation Ct. In S811, the CPU 40 issues a stop instruction to the motor 39. In S812, the CPU 40 starts counting the amount of inertial rotation Cl. In S813, the motor 39 actually stops. In S814, the CPU 40 ends counting the amount of inertial rotation Cl. In S815, the CPU 40 judges whether or not the number of intermittent drives i executed up to this step has reached a prescribed total number of drives N. If the result shows i=N, the CPU 40 ends the stop sequence. On the other hand, if the result does not show i=N, the processing proceeds to S816.

In S816, the CPU 40 corrects the amount of rotation for stop instruction issuance Mt that will be applied to the (i+1)th drive based on the target amount of rotation D and the amount of inertial rotation Cl. For example, the CPU 40 calculates the difference between the target amount of rotation D and the amount of inertial rotation Cl (Mt=D−Cl). This difference is used as the amount of rotation for stop instruction issuance Mt for the next drive. In S817, the CPU 40 increments the variable i by one, which indicates the number of intermittent drives that have been executed. After that, the processing returns to S805.

As described above, according to Embodiment 1, control is performed such that the final total amount of rotation when the photosensitive drum 1 is intermittently driven N times reaches the prescribed amount, and thus the phase difference due to variations between the loads on the motor 39C and 39K is reduced. This enables reducing streaks, image blurring, and color misalignment resulting from the phase difference between the image carriers, without increasing the first print-out time. Specifically, the amounts of rotation for stop instruction issuance Mt are corrected for the second to the Nth intermittent drives, in consideration of the variation in the previous intermittent drive. Accordingly, streaks and image blurring (density fluctuation and the like) that occur according to the rotational cycle of the photosensitive drum 1 is suppressed, and color misalignment is also reduced.

Embodiment 2

In Embodiment 2, the amounts of rotation for stop instruction issuance Mt that will be applied from the first to (N−1)th intermittent drives are not corrected, and the amount of rotation for stop instruction issuance Mt that will be applied to the Nth final intermittent drive is corrected. Here, the amounts of rotation for stop instruction issuance applied from the first to (N−1)th intermittent drive are set to Mt(N−1). Note that the values of all of MT(1), MT(2), . . . , Mt(N−1) are the same. The target total amount of rotation from when the first intermittent drive starts until when the Nth intermittent drive ends is assumed to be Da. The total amount of rotation measured from when the first intermittent drive starts until when the (N−1)th intermittent drive ends is assumed to be Ca. The amount of rotation for stop instruction issuance applied to the Nth intermittent drive is assumed to be Mt(N). In Embodiment 2, the CPU 40 determines the amount of rotation for stop instruction issuance Mt(N) applied to the Nth intermittent drive based on Mt(N−1), Da, and Ca. Note that the target total amount of rotation is also included in the target amount of rotation D described in Embodiment 1 in a broad sense. That is, a target amount of rotation is a target amount of rotation for each time an image carrier (drum) is driven, or a sum target amount of rotation thereof being driven for a plurality of times. Further, the total amount of rotation is also included in the amount of inertial rotation Cl described in Embodiment 1 in a broad sense. That is, the amount of inertial rotation is the amount of rotation due to one drive, or is a sum amount of rotation due to a plurality of drives. These are also the same in other embodiments.

Figure 9:
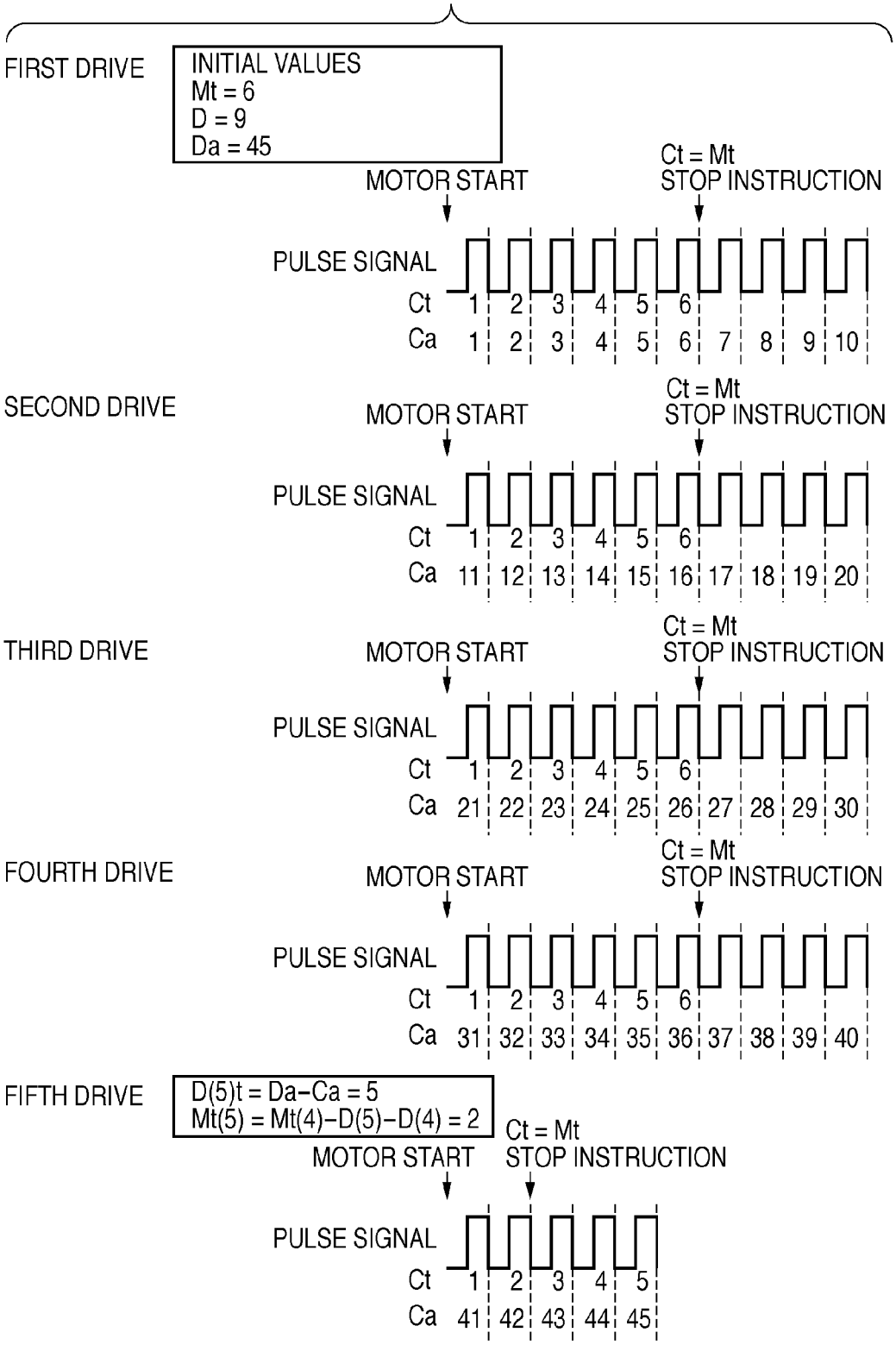
FIG. 9 is a diagram illustrating a photosensitive drum stop sequence.

FIG. 9 is a diagram illustrating the stop sequence of the photosensitive drums. In Embodiment 2, the CPU 40 counts the total amount of rotation Ca, which is the total number of pulses after the stop sequence is started. As shown in FIG. 9, since the number of intermittent drives to be executed is 5, the total amount of rotation Ca due to the first to fourth intermittent drives is measured. Note that while performing the first to fourth intermittent drives, the CPU 40 issues a stop instruction every time Ct=6.

The CPU 40 determines the target amount of rotation D(5) for the fifth drive by subtracting the total amount of rotation Ca due to the first to fourth intermittent drives from the target total amount of rotation Da. Furthermore, the CPU 40 calculates a difference d between the target amount of rotation D(5) for the fifth intermittent drive and the target amount of rotation D(4) for the fourth intermittent drive D. Note that the values of all of D(1) to D(4) are the same, that is, 9 in Embodiment 2. The CPU 40 determines the amount of rotation for stop instruction issuance Mt for the fifth intermittent drive(5) by subtracting the absolute value of the difference d from the amount of rotation for stop instruction issuance Mt(4) for the fourth intermittent drive. Mt(5)=Mt(4)−|(D5)−D(4)| In this way, by correcting the amount of rotation for stop instruction issuance Mt(5) for the fifth intermittent drive, the total amount of rotation Ca approximates the target total amount of rotation Da in the entire stop sequence.

Figure 10:
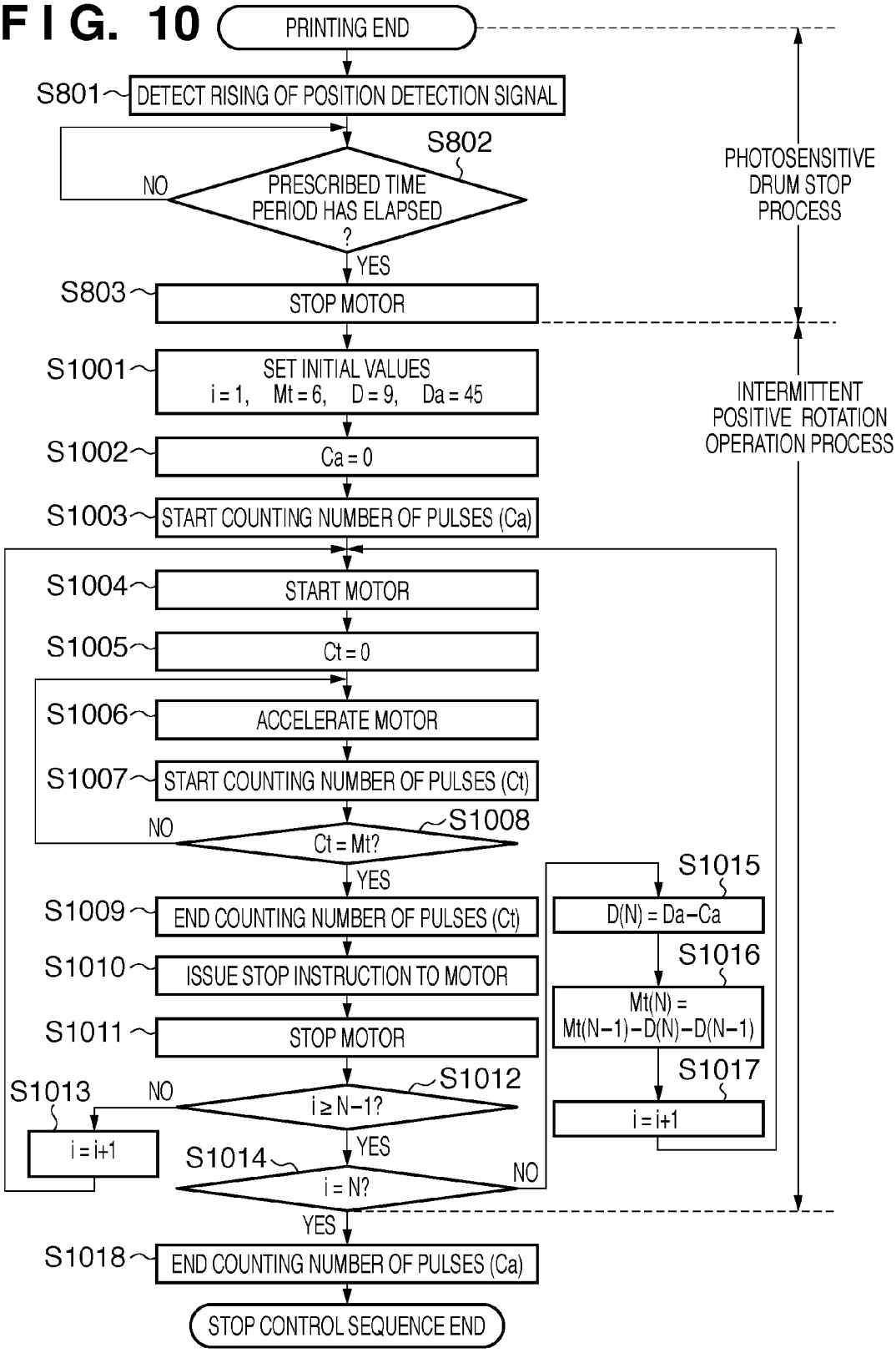
FIG. 10 is a flowchart showing an example of the stop sequence.

FIG. 10 is a flowchart showing an example of the stop sequence. Note that the description is simplified by giving the same reference numerals to the steps that have already been described. When the photosensitive drum stop process ends, the processing proceeds to the intermittent positive rotation operation process according to Embodiment 2.

In S1001, the CPU 40 sets the variables to be used to initial values. As one example, if N=5, the CPU 40 sets, for example, the amounts of rotation for stop instruction issuance Mt for the first to fourth drives to 6, and the target amounts of rotation D for the first to fourth drives to 9. Further, the variable i that indicates the number of the current intermediate drive is set to 1. Furthermore, the target total amount of rotation Da is set to 45. The target total amount of rotation Da is determined based on the result of experimentation or the like.

In S1002, the CPU 40 resets the total amount of rotation Ca to zero. In S1003, the CPU 40 starts counting the total amount of rotation Ca. In S1004, the CPU 40 starts up the motor 39. In S1005, the CPU 40 resets the amount of drive rotation Ct to zero. In S1006, the CPU 40 accelerates the motor 39 with a certain angular acceleration. In S1007, the CPU 40 starts counting the amount of drive rotation Ct. In S1008, the CPU 40 judges whether or not the values show Ct=Mt. If the values do not show Ct=Mt, the processing returns to step S1006. On the other hand, if the values show Ct=Mt, the processing proceeds to step S1009.

In S1009, the CPU 40 ends counting the amount of drive rotation Ct. In S1010, the CPU 40 issues a stop instruction to the motor 39. In S1011, the motor 39 actually stops. In S1012, the CPU 40 judges whether or not the number of intermittent drives i that have been executed up to this step is N−1 or more. If the judgment does not indicate i≥N−1, the processing proceeds to S1013, and the CPU 40 increments the value of i by one. After that, the processing returns to S1004.

On the other hand, if the judgment indicates i≥N−1, the processing proceeds to S1014, where the CPU 40 judges whether or not the values show i=N. If the values show i=N, the processing proceeds to S1018, and the CPU 40 ends the stop sequence. On the other hand, if the values do not show i=N, the processing proceeds to S1015.

In S1015, the CPU 40 determines the target amount of rotation D(N) for the Nth drive using the target total amount of rotation Da and the total amount of rotation Ca. For example, the target amount of rotation D(N) for the Nth drive is calculated by subtracting the total amount of rotation Ca from the target total amount of rotation Da. In S1016, the CPU 40 determines the amount of rotation for stop instruction issuance Mt(N) for the next Nth drive based on Mt(N−1), D(N−1), and D(N). The CPU 40 may use the following equation, for example.

$$Mt(N)=Mt(N-1)-|D(N)-D(N-1)|$$

After that, the processing proceeds to S1017, where the CPU 40 increments the value of i by one. After that, the processing returns to S1004.

As described above, according to Embodiment 2, the same effects as those in Embodiment 1 are achieved. Specifically, the target amounts of rotation D and the amounts of rotation for stop instruction issuance Mt are not corrected for the second to (N−1)th drives, and the target amount of rotation D(N) and the amount of rotation for stop instruction issuance Mt(N) for the final Nth drive are corrected using the target total amount of rotation Da and the total amount of rotation Ca. Specifically, the influence due to variations between loads is reduced in the Nth intermittent drive. Accordingly, streaks and image blurring (density fluctuation and the like) that occur according to the rotational cycle of the photosensitive drum 1 are suppressed, and color misalignment is also reduced.

Embodiment 3

In Embodiment 3, a method for correcting the amounts of rotation for stop instruction issuance Mt for the first to (N−1) th drives is the same as in Embodiment 1. However, in Embodiment 3, a method for determining the amount of rotation for stop instruction issuance Mt(N) for the Nth drive is different. Specifically, the CPU 40 determines the amount of rotation for stop instruction issuance Mt(i) for the ith drive (i is a natural number of 2 or more and N−1 or less), based on the target amount of rotation D and the amount of inertial rotation Cl(i−1) due to the (i−1)th drive. The CPU 40 determines the target amount of rotation D(N) for the Nth drive based on the target total amount of rotation Da and the total amount of rotation Ca that has been measured from the start of the first intermittent drive until the end of the (N−1)th intermittent drive. Furthermore, the CPU 40 determines the amount of rotation for stop instruction issuance Mt(N) for the Nth drive, which is the drive subsequent to the (N−1)th drive, based on the target amount of rotation D(N) for the Nth drive and the amount of inertial rotation Cl(N−1) due to the (N−1)th drive.

Figure 11:
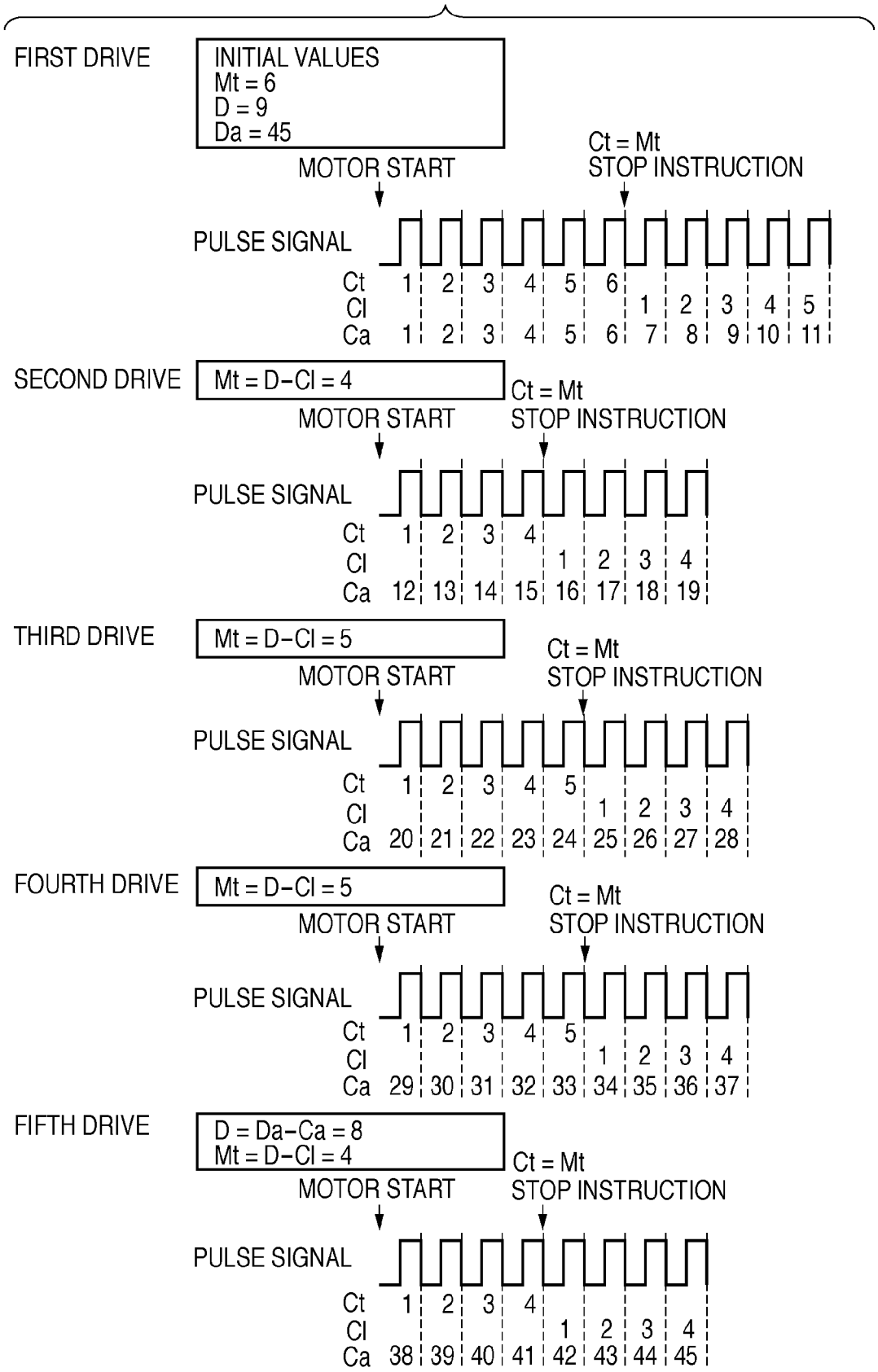
FIG. 11 is a diagram illustrating a photosensitive drum stop sequence.

FIG. 11 is a diagram illustrating the stop sequence. The initial values of the variables here are the same as those in Embodiments 1 and 2 for the convenience of the description. Processing for the first to fourth drives is basically the same as that in Embodiment 1. However, Embodiments 3 and 2 are similar in counting the total amount of rotation Ca.

In Embodiment 3, when the fourth intermittent drive ends, the CPU 40 determines the target amount of rotation D(5) for the fifth drive based on the target total amount of rotation Da and the total amount of rotation Ca that has been measured from the first to fourth drives (D(5)=Da−Ca). Furthermore, the CPU 40 determines the amount of rotation for stop instruction issuance Mt(5) for the fifth drive based on the target amount of rotation D(5) for the fifth drive and the amount of inertial rotation Cl(4) due to the fourth drive (Mt(5)=D(5)−Cl(4)).

Figure 12:
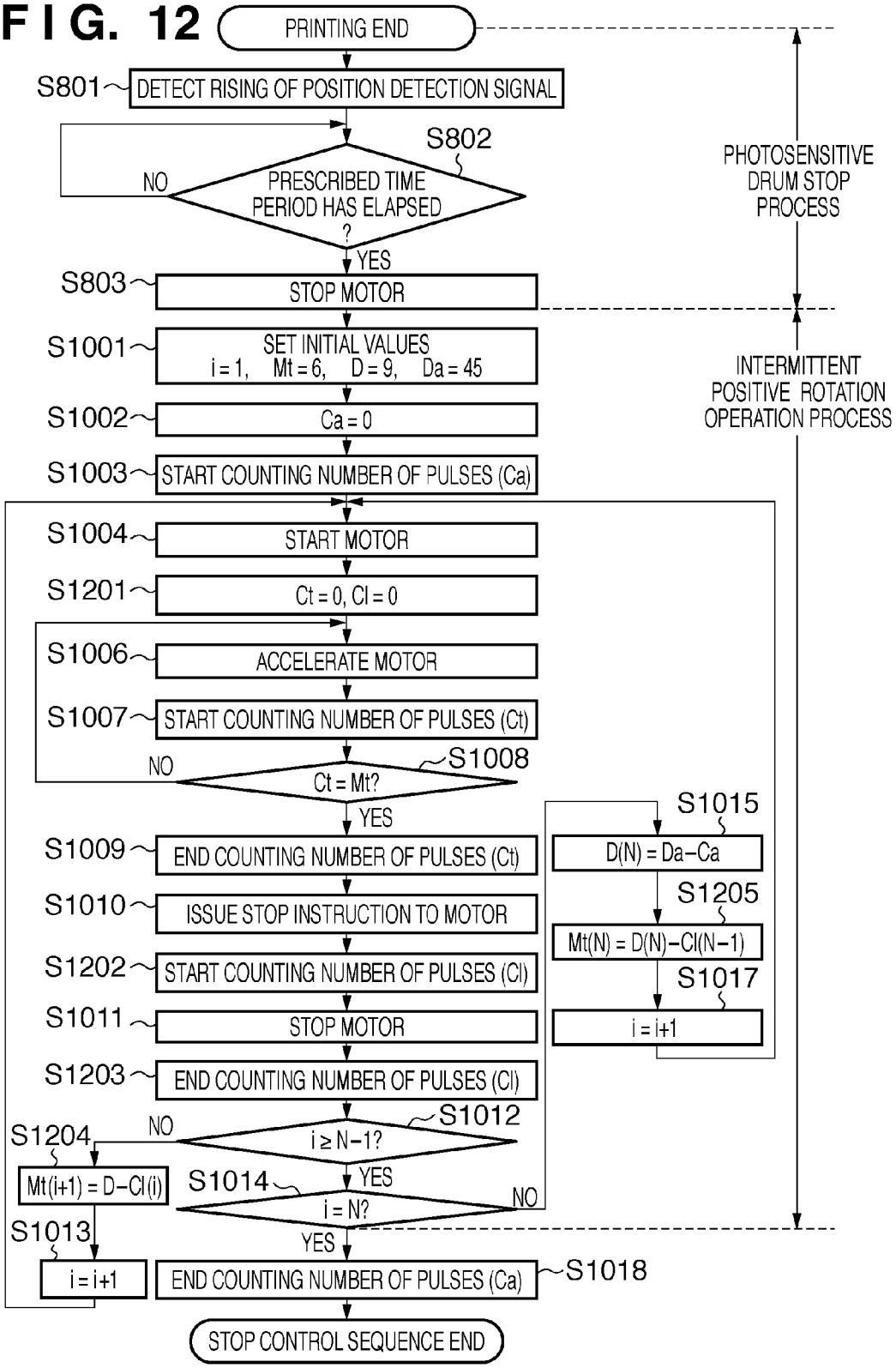
FIG. 12 is a flowchart showing an example of the stop sequence.

FIG. 12 is a flowchart showing an example of the stop sequence. The same reference numerals are given to the parts that have already been described. Note that since the flowchart in Embodiment 3 is quite similar to the flowchart in Embodiment 2, only the difference therebetween is described in detail.

S801 to S1004 are the same as those described in Embodiment 2. In Embodiment 3, S1201 is adopted instead of S1005. In S1201, the CPU 40 resets the amount of drive rotation Ct(i) and the amount of inertial rotation Cl(i) to zero. After that, S1006 to S1010 are executed. S1202 is newly interposed between S1010 and S1011. In S1202, the CPU 40 starts counting the amount of inertial rotation Cl(i). S1203 is interposed newly between S1011 and S1012. In S1203, the CPU 40 ends counting the amount of inertial rotation Cl(i).

S1204 is provided between S1012 and S1013 in order to correct the amounts of rotation for stop instruction issuance Mt(i+1) for the second to (N−1)th drives. In S1204, the CPU 40 determines the amount of rotation for stop instruction issuance Mt(i+1) for the (i+1)th drive based on the target amount of rotation D and the amount of inertial rotation Cl(i) due to the ith drive. For example, the CPU 40 calculates the amount of rotation for stop instruction issuance Mt(i+1) by subtracting the amount of inertial rotation Cl(i) from the target amount of rotation D.

In order to determine the amount of rotation for stop instruction issuance Mt(N) for the Nth drive, S1205 is adopted instead of S1016. In S1205, the CPU 40 determines the amount of rotation for stop instruction issuance Mt(N) for the Nth drive based on the target amount of rotation D(N) for the Nth drive and the amount of inertial rotation Cl(N−1) due to the (N−1)th drive. For example, the CPU 40 determines the amount of rotation for stop instruction issuance Mt(N) by subtracting the amount of inertial rotation Cl(N−1) from the target amount of rotation D(N).

In this way, the same effects as those in Embodiments 1 and 2 are also achieved in Embodiment 3.

Embodiment 4

In Embodiment 4, the target amount of rotation D(i) for the ith drive is determined based on the target total amount of rotation Da, the total amount of rotation Ca that has been measured from the first to the (i−1)th drives, and a prescribed coefficient (N−i+1). Note that the amount of rotation for stop instruction issuance Mt(i) for the ith drive is determined based on the amount of inertial rotation Cl (i−1) measured due to the (i−1)th intermittent drive and the target amount of rotation D(i).

Figure 13:
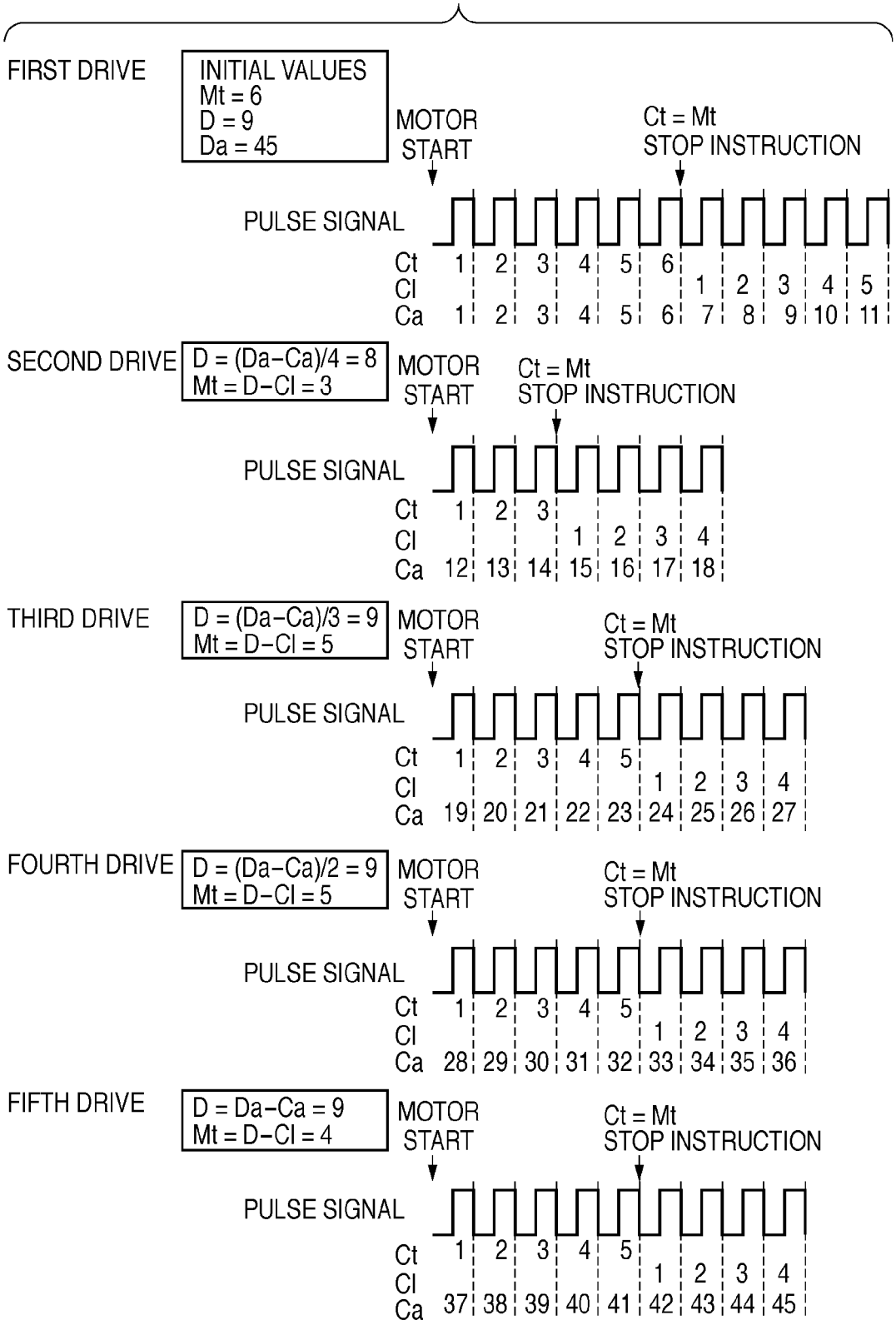
FIG. 13 is a diagram illustrating a photosensitive drum stop sequence.

FIG. 13 is a diagram illustrating the stop sequence. For convenience, the same initial values as those in other embodiments are used. A method for determining the amount of rotation for stop instruction issuance Mt(i) in Embodiment 4 is common with that in Embodiment 3. However, the difference is that the target amount of rotation D(i) for the second to Nth drives is corrected each time. For example, the CPU 40 determines the target amount of rotation D(i) for the ith drive using the following equation.

$$D(i)=(Da-Ca)/(N-i+1)$$

The target amount of rotation D(2) for the second drive is obtained as follows.

$$\begin{aligned} D(2) &= (45-11)/(5-2+1) \\ &= 34/4 \\ &= 8 \end{aligned}$$

Note that the remainder generated in the division is omitted. The amount of rotation for stop instruction issuance Mt(2) for the second drive is obtained as follows.

$$\begin{aligned} Mt(2) &= D(2) - Cl(1) \\ &= 8-5 \\ &= 3 \end{aligned}$$

For the subsequent third to Nth drives, the next target amount of rotation and the next amount of rotation for stop instruction issuance are sequentially determined using the same method.

Figure 14:
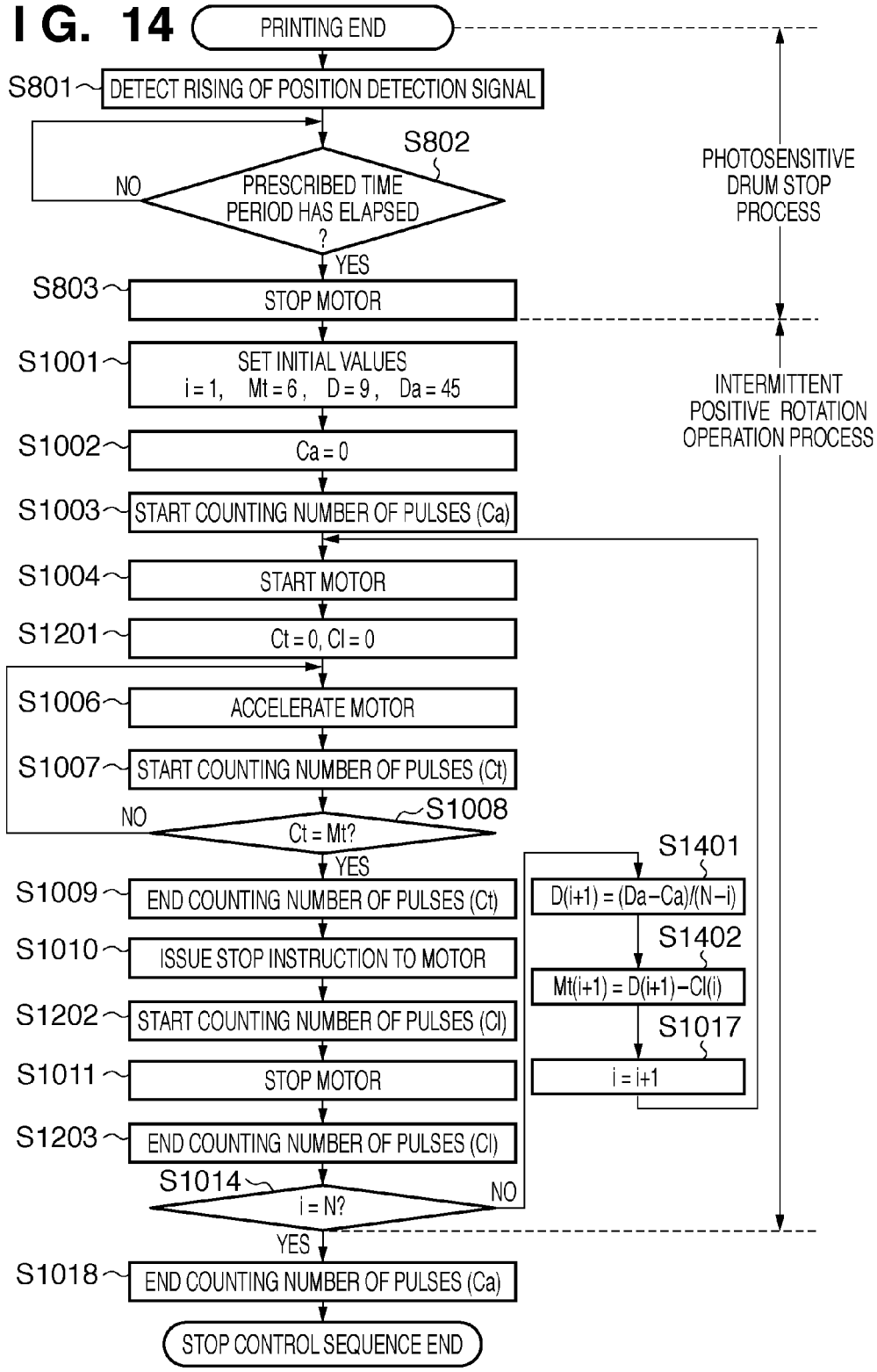
FIG. 14 is a flowchart showing an example of the stop sequence.

FIG. 14 is a flowchart showing an example of the stop sequence. Note that the description is simplified by giving the same reference numerals to the steps that have already been described. In particular, compared to FIG. 12, S1012, S1204, and S1013 are omitted in FIG. 14, and furthermore S1015 and S1205 are replaced by S1401 and S1402. Accordingly, S1014 is arranged after S1203. If the values do not show i=N in S1014, the processing proceeds to S1401.

In S1401, the CPU 40 determines the target amount of rotation D(i+1) for the (i+1)th drive. The CPU 40 obtains a difference by subtracting the total amount of rotation Ca from the target total amount of rotation Da. Furthermore, the CPU 40 determines the target amount of rotation D(i+1) for the (i+1)th drive by dividing the calculated difference by a coefficient (N−i).

Next, in S1402, the CPU 40 determines the amount of rotation for stop instruction issuance Mt(i+1) that will be applied to the (i+1)th drive. For example, the CPU 40 calculates the amount of rotation for stop instruction issuance Mt(i+1) by subtracting the amount of inertial rotation Cl(i) from the target amount of rotation D(i+1). After that, the processing proceeds to S1017.

Thus, the same effects as those in Embodiment 3 are also achieved in Embodiment 4.

Embodiment 5

In Embodiment 5, the target amount of rotation D(i) for the ith drive (i is a natural number of 2 or more) is determined based on the target total amount of rotation Da(i) from when the first drive of the image carrier starts until when the ith drive ends, and the total amount of rotation Ca measured up to the (i−1)th drive. Furthermore, a method for determining the amount of rotation for stop instruction issuance Mt(i) is the same as that described in Embodiment 4. Note that the target total amounts of rotation Da(1) to Da(N) are determined by conducting experimentation in advance, for instance. Further, the target total amounts of rotation Da(1) to Da(N) are held in a table, for example.

Figure 15:
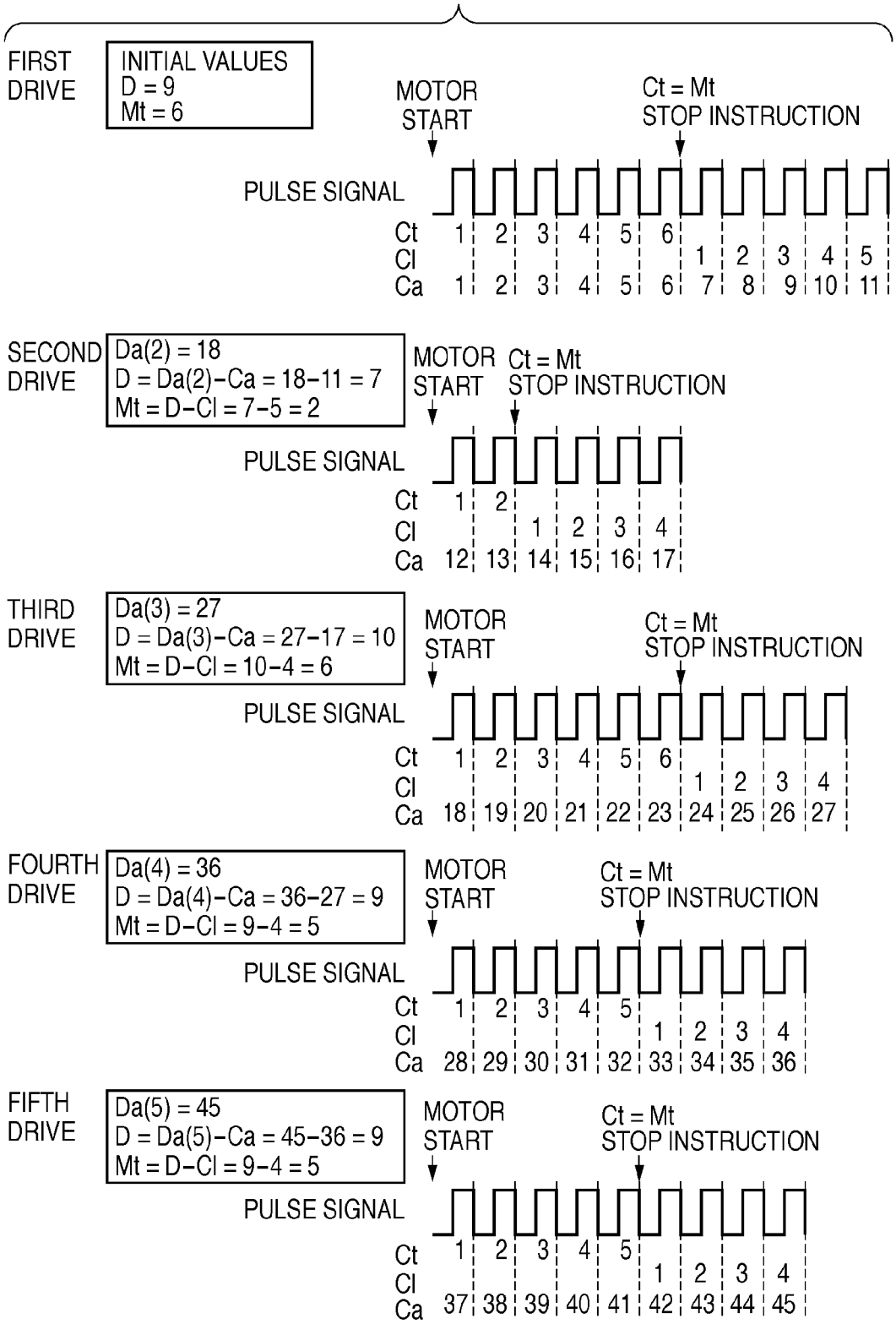
FIG. 15 is a diagram illustrating a photosensitive drum stop sequence.

FIG. 15 is a diagram illustrating the stop sequence. The target total amount of rotation Da(1) read from the table is assigned to the target amount of rotation D(1) for the first drive. FIG. 16 is a diagram showing an example of a table having stored therein the target total amounts of rotation Da(i). The target total amounts of rotation Da(i) for the first to Nth drives are stored in the table.

As shown in FIG. 15, the target amounts of rotation D(i) for the second and following drives are determined by subtracting the total amount of rotation Ca from the target total amount of rotation Da(i) read from the table. For example, the table shown in FIG. 16 shows that Da(2) is 18. Further, FIG. 15 shows that Ca is 11. Therefore, the amount is obtained as follows.

$$D=18-11=7$$

Further, the amount of rotation for stop instruction issuance Mt(2) for the second drive is determined by subtracting Cl(1) from D(2).

Specifically, the amount is obtained as follows.

$$Mt(2)=7-5=2$$

The target amounts of rotation D(i) and the amounts of rotation for stop instruction issuance Mt(i) for the third and the following drives are also determined using the same method.

Figure 17:
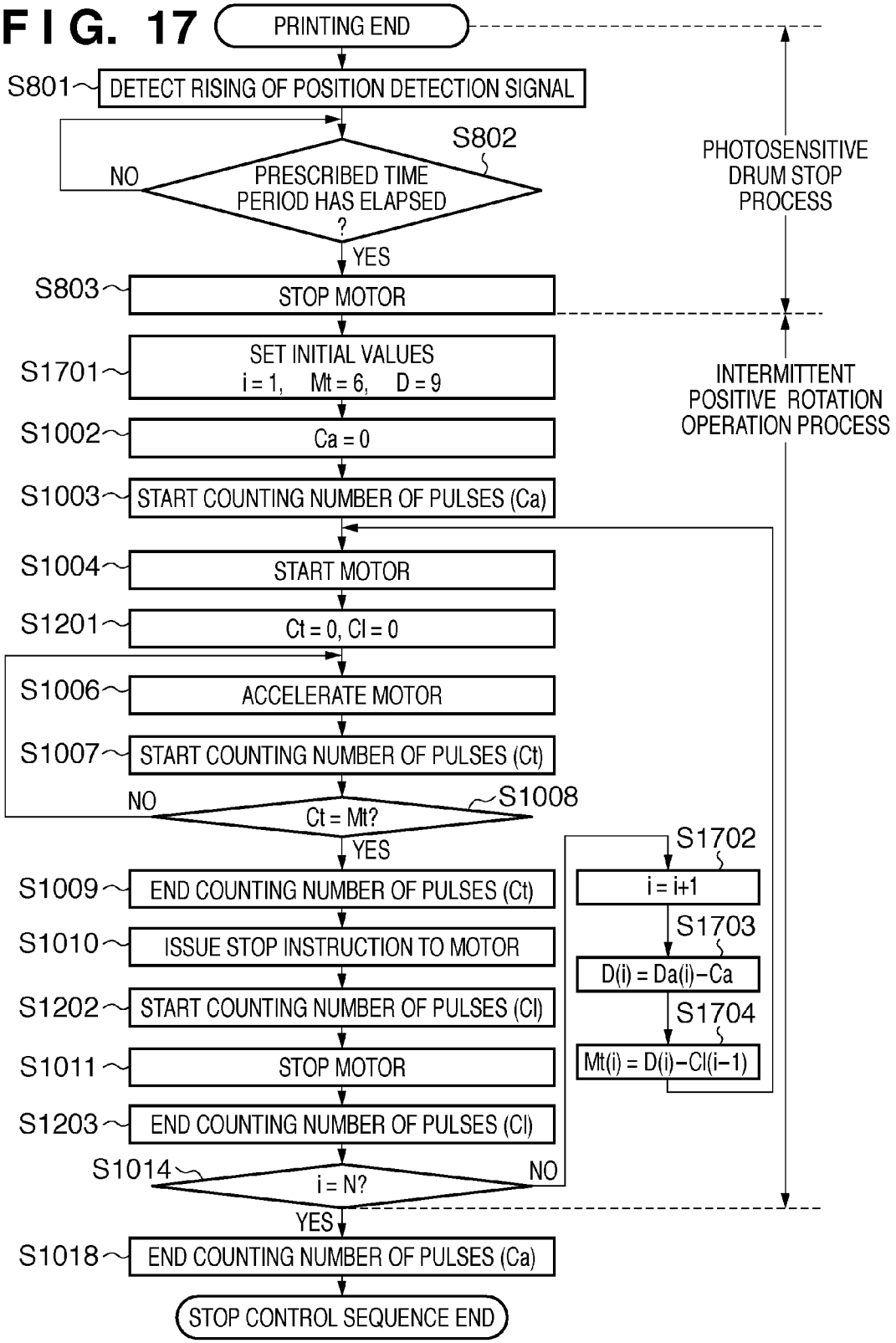
FIG. 17 is a flowchart showing an example of the stop sequence.

FIG. 17 is a flowchart showing an example of the stop sequence. Compared to FIG. 14, S1001 is replaced by S1701, and S1401, S1402, and S1017 are replaced by S1702 to S1704.

In S1701, the CPU 40 sets the variables to initial values. Note that the value of the target total amount of rotation Da(1) read from the table is assigned to the target amount of rotation D(1).

If it is judged in S1014 that the values do not show i=N, the processing proceeds to S1702. In S1702, the CPU 40 increments the value of i by one. In S1703, the CPU 40 determines the target amount of rotation D(i) based on the measured total amount of rotation Ca and the target total amount of rotation Da(i) read from the table. For example, the amount is obtained as follows.

$$D(i)=Da(i)-Ca.$$

In S1704, the CPU 40 determines the amount of rotation for stop instruction issuance Mt(i) based on the target amount of rotation D(i) and the amount of inertial rotation Cl(i−1). After that, the processing returns to S1004. In this way, the same effects as those in Embodiment 4 are also achieved in Embodiment 5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-251354, filed Oct. 30, 2009, which is hereby incorporated by reference herein in its entirety.

What is claimed is:

1. An image forming apparatus, comprising:

an image carrier that carries an image formed using a developer;

a drive source that drives the image carrier to rotate;

a cleaning member that contacts the image carrier and removes the developer from the surface of the image carrier;

a control unit that controls the drive source such that when transfer of the image formed using the developer to a recording medium ends, the image carrier is temporarily stopped, and thereafter the image carrier is intermittently driven N times (N is a natural number of two or more);

a measuring unit that measures an amount of rotation of the image carrier when the image carrier is intermittently driven, wherein the control unit issues a stop instruction to the drive source when an amount of drive rotation Ct measured by the measuring unit since a start of driving of the image carrier reaches a prescribed amount of rotation for stop instruction issuance Mt; and a determination unit that determines an amount of rotation for stop instruction issuance Mt that will be applied to a next drive based on an amount of inertial rotation Cl that is measured by the measuring unit from when the stop instruction is issued until when the image carrier stops rotating, and a target amount of rotation D during the intermittent drive of the image carrier.

2. The image forming apparatus according to claim 1, wherein the determination unit determines, in the intermittent drive of the image carrier, a difference between the target amount of rotation D and the amount of inertial rotation Cl as being the amount of rotation for stop instruction issuance Mt that will be applied to the next drive.

3. The image forming apparatus according to claim 1, wherein the determination unit does not correct an amount of rotation for stop instruction issuance Mt that is applied from first to (N−1)th drives, and determines an amount of rotation for stop instruction issuance Mt that will be applied to an Nth drive based on the amount of rotation for stop instruction issuance Mt that is applied from the first to (N−1)th drives, a target total amount of rotation Da, which is a sum of target amounts of rotation D from a start of the first drive of the image carrier until an end of the Nth drive, and a total amount of rotation Ca, which is a sum of an amount of drive rotation Ct and amounts of inertial rotation Cl that have been measured from the start of the first drive of the image carrier until an end of the (N−1)th drive.

4. The image forming apparatus according to claim 3, wherein the determination unit determines a difference between the target total amount of rotation Da and the total amount of rotation Ca as being a target amount of rotation D(N) for the Nth drive, and determines the amount of rotation for stop instruction issuance Mt that will be applied to the Nth drive by subtracting a difference between the target amount of rotation D(N) for the Nth drive and a target amount of rotation D(N−1) for the (N−1)th drive from the amount of rotation for stop instruction issuance Mt that is applied to the (N−1)th drive.

5. The image forming apparatus according to claim 1, wherein the determination unit determines an amount of rotation for stop instruction issuance Mt that is applied to an ith drive (i is a natural number of 2 or more and N−1 or less) based on the target amount of rotation D and the amount of inertial rotation Cl that has been measured due to an (i−1)th drive, and determines an amount of rotation for stop instruction issuance Mt that will be applied to the Nth drive based on an amount of inertial rotation Cl that has been measured due to the (N−1)th drive, a target total amount of rotation Da, which is a sum of target amounts of rotation D from a start of a first drive of the image carrier until an end of the Nth drive, and a total amount of rotation Ca, which is a sum of an amount of drive rotation Ct and amounts of inertial rotation Cl, that has been measured from the start of the first drive of the image carrier until an end of the (N−1)th drive.

6. The image forming apparatus according to claim 5, wherein the determination unit determines a target amount of rotation D(N) that will be applied to the Nth drive by subtracting the total amount of rotation Ca from the target total amount of rotation Da, and determines an amount of rotation for stop instruction issuance Mt that will be applied to the Nth drive by subtracting an amount of inertial rotation Cl that has been measured due to the (N−1)th drive from the target amount of rotation D(N) that will be applied to the Nth drive.

7. The image forming apparatus according to claim 1, wherein the determination unit determines a target amount of rotation D(i) that will be applied to an ith drive (i is a natural number of 2 or more and N or less) of the image carrier based on a target total amount of rotation Da, which is a sum of target amounts of rotation D(i) from a start of a first drive of the image carrier until an end of the Nth drive, a total amount of rotation Ca, which is a sum of an amount of drive rotation Ct and amounts of inertial rotation Cl, that has been measured from the start of the first drive of the image carrier until an end of an (i−1)th drive, and a prescribed coefficient (N−i+1), and determines an amount of rotation for stop instruction issuance Mt(i) that will be applied to the ith drive based on an amount of inertial rotation Cl that has been measured due to the (i−1)th drive and the target amount of rotation D(i).

8. The image forming apparatus according to claim 7, wherein the determination unit determines the target amount of rotation D(i) that will be applied to the ith drive of the image carrier by dividing a difference between the target total amount of rotation Da and the total amount of rotation Ca by the prescribed coefficient (N−i+1), and determines a difference between the target amount of rotation D(i) that will be applied to the ith drive of the image carrier and an amount of inertial rotation Cl that has been measured due to the (i−1)th drive, as being the amount of rotation for stop instruction issuance Mt(i) that will be applied to the ith drive.

9. The image forming apparatus according to claim 1, wherein the determination unit determines a target amount of rotation D(i) that will be applied to an ith drive (i is a natural number of 2 or more and N or less) based on a target total amount of rotation Da(i), which is a sum of target amounts of rotation D(i) from a start of a first drive of the image carrier until an end of the ith drive, and a total amount of rotation Ca, which is a sum of an amount of drive rotation Ct and amounts of inertial rotation Cl, that has been measured from the start of the first drive of the image carrier until an end of an (i−1)th drive, and determines an amount of rotation for stop instruction issuance Mt(i) that will be applied to the ith drive based on the target amount of rotation D(i) that will be applied to the ith drive, and an amount of inertial rotation Cl that has been measured due to the (i−1)th drive.

10. The image forming apparatus according to claim 9, wherein the determination unit determines the target amount of rotation D(i) that will be applied to the ith drive by subtracting a total amount of rotation Ca that has been measured from the start of the first drive of the image carrier until the end of the (i−1)th drive from the target total amount of rotation Da(i) from the start of the first drive of the image carrier until the end of the ith drive, and determines the amount of rotation for stop instruction issuance Mt(i) that will be applied to the ith drive by subtracting the amount of inertial rotation Cl that has been measured due to the (i−1)th drive from the target amount of rotation D(i) that will be applied to the ith drive.

11. The image forming apparatus according to claim 1, wherein the measuring unit includes:

a generation unit that generates a pulse signal in synchronization with rotation of the drive source; and a count unit that counts the number of pulses included in the pulse signal as an amount of rotation.

12. The image forming apparatus according to claim 1, wherein a distance that the surface of the image carrier moves by the image carrier being intermittently driven N times is longer than a width of a nip portion that is formed by the image carrier and the cleaning member being in contact with each other.

13. A control method for an image forming apparatus including an image carrier that carries an image formed using a developer, a drive source that drives the image carrier to rotate, and a cleaning member that contacts the image carrier and removes the developer from the surface of the image carrier, the control method comprising:

a control step of controlling the drive source such that when transfer of the image formed using the developer to a recording medium ends, the image carrier is temporarily stopped, and thereafter the image carrier is intermittently driven N times (N is a natural number of two or more), wherein the control step includes:

a measuring step of measuring an amount of rotation of the image carrier when the image carrier is intermittently driven;

an issuing step of issuing a stop instruction to the drive source when an amount of drive rotation Ct that has been measured in the measuring step since a start of driving of the image carrier reaches a prescribed amount of rotation for stop instruction issuance Mt; and a determination step of determining an amount of rotation for stop instruction issuance Mt that will be applied to a next drive based on an amount of inertial rotation Cl that is measured in the measuring step from when the stop instruction is issued until when the image carrier stops rotating, and a target amount of rotation D during the intermittent drive of the image carrier.

* * * * *